US005709019A

United States Patent [19]

Sawdon

[11] Patent Number: 5,709,019

[45] Date of Patent: *Jan. 20, 1998

[54] APPARATUS FOR JOINING SHEETS OF MATERIAL

[75] Inventor: Edwin G. Sawdon, St. Clair, Mich.

[73] Assignee: BTM Corporation, Marysville, Mich.

[ * ] Notice: The portion of the term of this patent subsequent to Jan. 13, 2014, has been disclaimed.

[21] Appl. No.: 549,437

[22] Filed: Oct. 27, 1995

Related U.S. Application Data

[63] Continuation of Ser. No. 189,580, Jan. 31, 1994, Pat. No. 5,479,187.

[51] Int. Cl.[6] ..... B23P 11/00

[52] U.S. Cl. ..... 29/243.5; 29/283.5; 72/465

[58] Field of Search ..... 29/21.1, 436, 505, 29/521, 522.1, 243.5, 283.5, 798; 72/481, 465, 393, 353.4

[56] References Cited

U.S. PATENT DOCUMENTS

| | | |
|---|---|---|
| 1,404,126 | 1/1922 | Krause . |
| 2,670,885 | 3/1954 | Allen . |
| 3,359,935 | 12/1967 | Rosbottom . |
| 3,404,648 | 10/1968 | Rosbottom . |
| 3,468,527 | 9/1969 | Mather . |
| 3,690,141 | 9/1972 | Brownbill . |
| 4,208,776 | 6/1980 | Schleicher . |
| 4,757,609 | 7/1988 | Sawdon . |
| 4,825,525 | 5/1989 | Obrecht et al. . |
| 4,905,362 | 3/1990 | Obrecht et al. . |
| 4,910,853 | 3/1990 | Sawdon . |
| 4,930,203 | 6/1990 | Obrecht et al. . |
| 5,027,503 | 7/1991 | Sawdon . |
| 5,150,513 | 9/1992 | Sawdon . |
| 5,177,861 | 1/1993 | Sawdon . |
| 5,509,290 | 4/1996 | Faivre ..... 29/798 |
| 5,528,815 | 6/1996 | Webb ..... 29/283.5 |

FOREIGN PATENT DOCUMENTS

| | | |
|---|---|---|
| 206465 | 10/1954 | Australia . |
| 1452782 | 3/1969 | Germany . |
| 3726392 | 2/1989 | Germany . |
| 4335318A1 | 4/1994 | Germany . |
| 62-148035 | 7/1987 | Japan . |
| 62-148036 | 7/1987 | Japan . |
| 62-148039 | 7/1987 | Japan . |
| 62-148040 | 7/1987 | Japan . |
| 1299669A | 3/1987 | U.S.S.R. . |
| 1041119 | 9/1986 | United Kingdom . |
| WO9314893 | 8/1993 | WIPO . |

*Primary Examiner*—David P. Bryant
*Attorney, Agent, or Firm*—Harness, Dickey & Pierce, P.L.C.

[57] ABSTRACT

An apparatus for joining sheets of material employs a die assembly having an anvil peripherally bordered by a plurality of movable die segments and a spring which urges the die segments radially toward the anvil. In a further aspect of the present invention, the spring is a coiled and canted spring. In another aspect of the present invention, the spring secures the die segments within an outer sleeve. In yet another aspect of the present invention, a unique die retainer has provisions for retaining a die assembly and for fastening such to a work surface.

55 Claims, 5 Drawing Sheets

APPARATUS FOR JOINING SHEETS OF MATERIAL

This is a continuation of U.S. patent application Ser. No. 08/189,580, filed Jan. 31, 1994, now U.S. Pat. No. 5,479,687.

BACKGROUND AND SUMMARY OF THE INVENTION

This invention relates generally to an apparatus for joining sheets of material and specifically to a die assembly and retainer used therein.

It is old in the art to join multiple pieces of sheet metal by punching or otherwise manipulating them to cause these sheets to be deformed into an interlocking relationship in a localized area. However, such joints have traditionally required the shearing of the sheet material and hence are not suitable for leak proof applications unless a sealant is applied. The formation of such joints is also frequently destructive of the corrosion resistance of coated materials. In addition, the known apparatuses for forming the joints are frequently complex in design. This complexity increases the cost of the equipment, as well as the energy required for operation.

More recently, the inventor of the present invention has developed an apparatus for producing more cost effective and aesthetically pleasing leak proof and lanced joints. These are known within the industry as Tog-L-Loc™ and Lance-N-Loc™ joints which can be obtained from the assignee of the present invention. These improved joints are disclosed within U.S. Pat. No. 5,150,513 which issued on Sep. 29, 1992 and U.S. Pat. No. 5,177,861 which issued on Jan. 12, 1993, both of which are incorporated by reference herein.

Moreover, the use of coiled springs to inwardly retain a plurality of movable die pieces against an anvil for joining sheets of material is shown in Japanese patents 148036 entitled "Joining Device For Thin Metallic Plate" and 148039 entitled "Joining Device For Metallic Sheet." However, in both of these devices, the coiled spring is not canted. Furthermore, an outer sleeve is not shown surrounding the spring and movable die pieces.

In accordance with the present invention, the preferred embodiment of a new and useful apparatus for joining sheets of material employs a die assembly having an anvil peripherally bordered by a plurality of movable die segments and a spring which urges the die segments radially toward the anvil. In a further aspect of the present invention, the spring is a coiled and canted spring. In another aspect of the present invention, the spring secures the die segments within an outer sleeve. In yet another aspect of the present invention, a unique die retainer has provisions for retaining a die assembly and for fastening such to a work surface.

The apparatus of the present invention is advantageous over conventional devices in that a plurality of die segments and a spring can be assembled to an anvil in a more cost effective, reliable and more durable manner. Furthermore, the spring and die segment construction of the present invention allows for quicker and easier disassembly and is self cleaning of undesirable foreign matter. Moreover, a spring serves to reliably retain a plurality of die segments within an outer sleeve regardless of the attitude of the die assembly. A canted spring of the present invention also allows a die assembly to be more compact in a radial direction as compared to prior uncanted spring devices. Furthermore, an outer casing substantially surrounds a plurality of die segments and a spring thereby protecting the die segments and spring from foreign matter and from inadvertent abuse. The specific mounting construction of die retainers of the present invention are also advantageous over traditional devices since the present invention provides for a secure yet easily removable die retainer which can be fastened to a variety of work surfaces. Additional advantages and features of the present invention will become apparent from the following description and appended claims, taken in conjunction with the accompanying drawings.

DETAILED DESCRIPTION OF THE PREFERRED EMBODIMENTS

Figure 1:
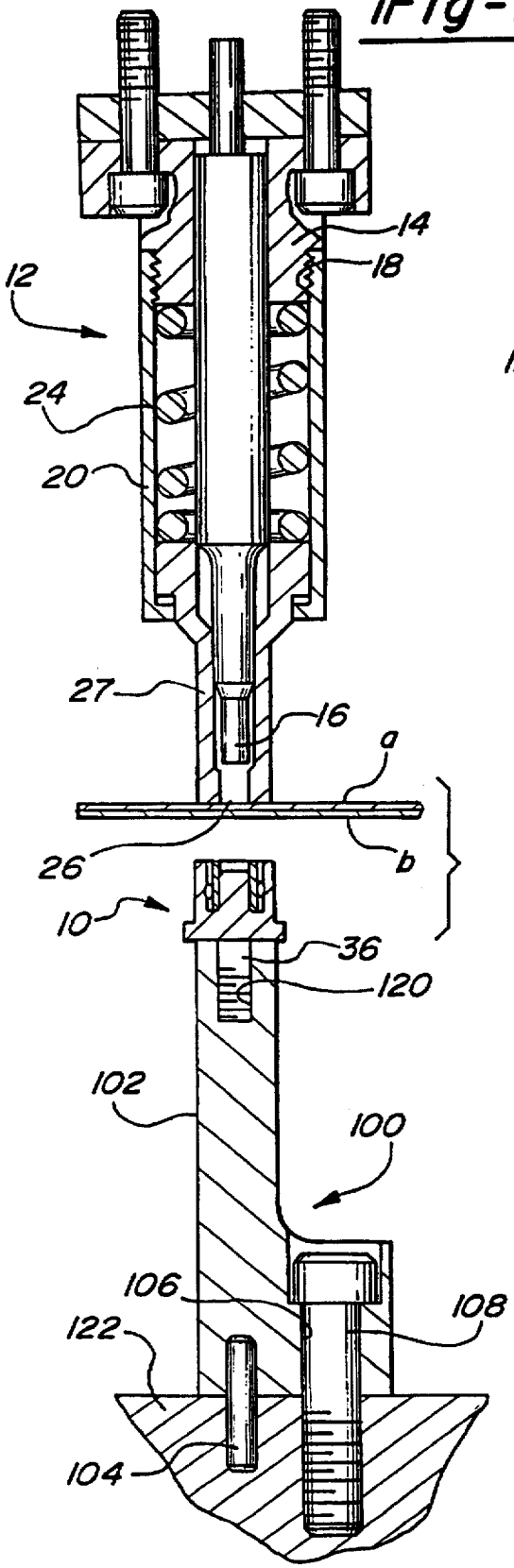
FIG. 1 is a front elevational view, partially in section, showing an apparatus incorporating the principles of a first preferred embodiment of the present invention, illustrated in its retracted position.
Figure 2:
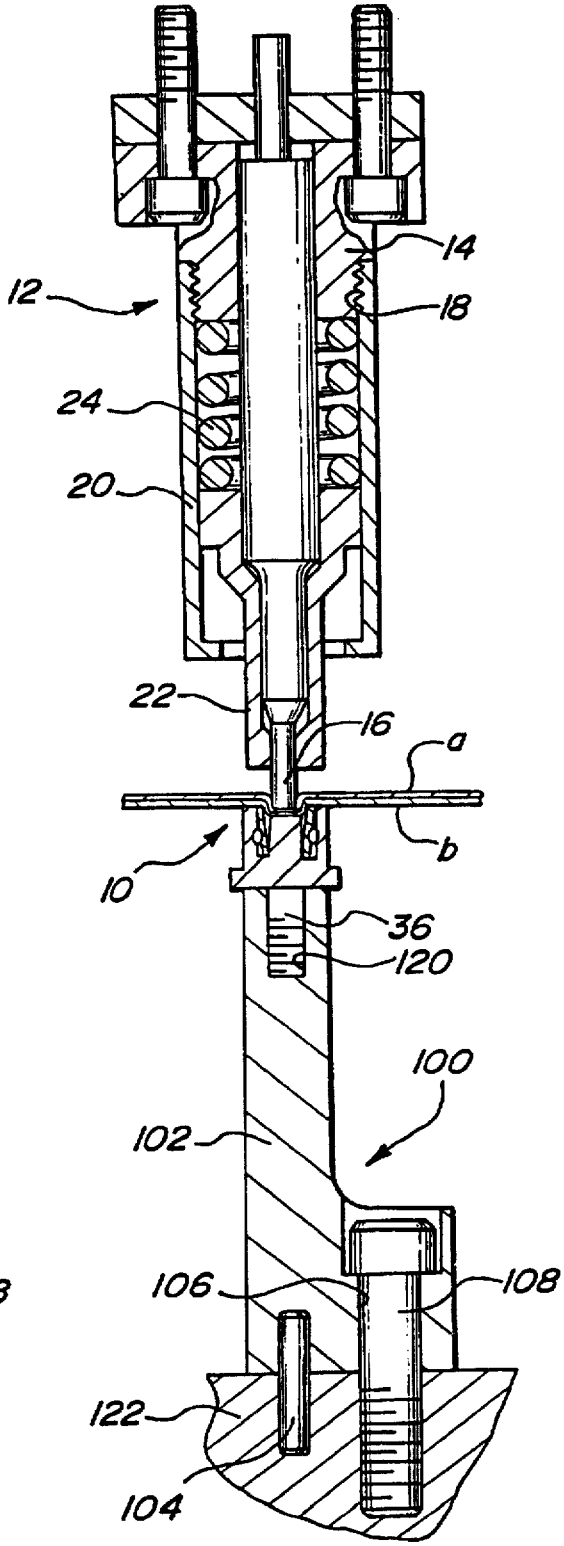
FIG. 2 is a view, similar to that of FIG. 1, showing the first preferred embodiment of the apparatus of the present invention in its advanced position.

Referring to FIGS. 1 and 2, a preferred embodiment of an apparatus of the present invention for joining sheets of material is comprised of a die assembly 10 and a punch assembly 12 for joining two pieces of sheet metal or other deformable sheet material, such as a deformable polymeric material, as indicated at a and b respectively. Although only two pieces of sheet material are shown, it is to be understood that more than two pieces may be joined in accordance with the principles of the present invention, depending upon the composition and thickness of the sheet material in question. It is envisioned that the most common materials to be joined by the present invention will include sheet stock materials, such as aluminum, galvanized, brass, steel, etc., both coated and uncoated. The invention is particularly useful and advantageous in joining sheet material items composed of different materials where such dissimilar materials cannot be welded to one another.

Punch assembly 12 is of conventional construction, including a punch body 14 mounting a circular punch 16 and having a threaded portion 18 for threadably supporting a stripper retainer 20. Disposed within stripper retainer 20 is a stripper 22 biased to the stripping position, illustrated in FIG. 1, by means of coiled stripping springs 24. Punch 16 preferably has a smooth flat working surface 26, with a small radius at the edge.

Figure 4:
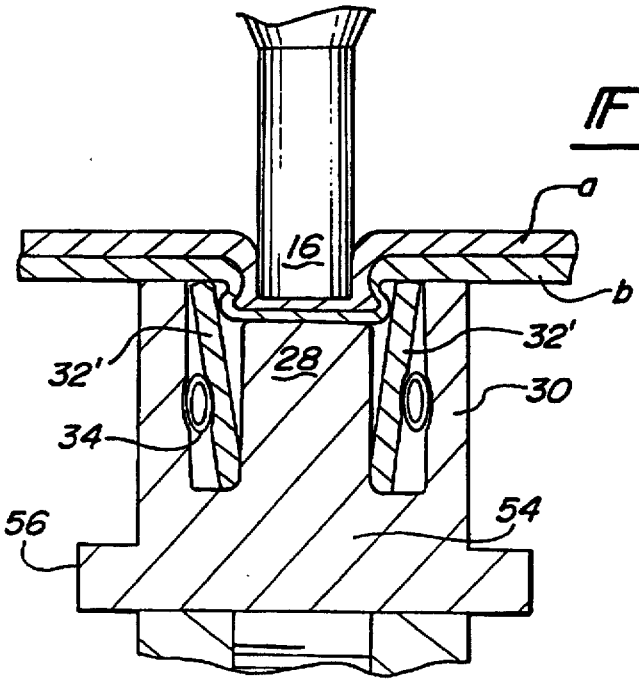
FIG. 4 is an enlarged fragmentary front elevational view, partially in section, showing a joint created by the apparatus of the present invention of FIG. 2.
Figure 6:
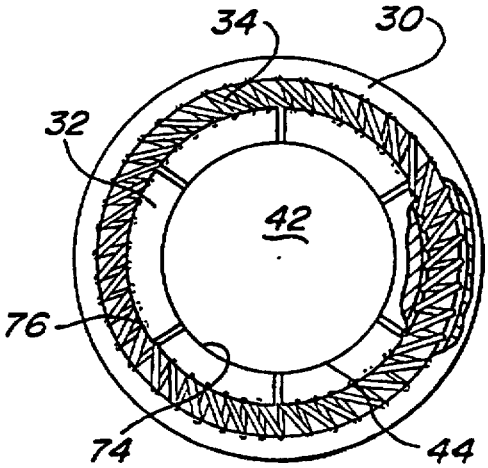
FIG. 6 is an enlarged top elevational view, with portions broken away therefrom, showing the first preferred embodiment of the die assembly of FIG. 5, employed in the apparatus of the present invention.
Figure 5:
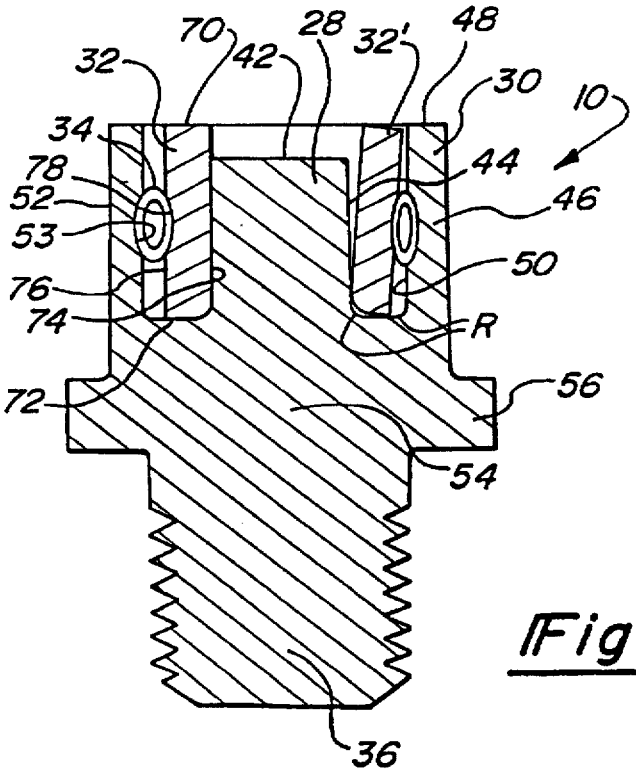
FIG. 5 is an enlarged sectional view, taken along line 5—5 of FIG. 3, showing the first preferred embodiment of the die assembly employed in the apparatus of the present invention.

As can best be observed in FIGS. 4 through 6, die assembly 10 is comprised of an anvil 28, an outer sleeve 30, a plurality of die segments 32, a spring 34 and a threaded shaft 36. Anvil 28 is shown as a substantially cylindrical member having a working surface 42 and a peripheral surface 44. Of course, anvil 28 may have a variety of other peripheral and working surface shapes and patterns depending upon the specific joint application. Sleeve 30 has a substantially annular upper portion 46 with an upper edge 48, an inner surface 50 and an outer surface 52. Upper portion 46 of sleeve 30 mates with anvil 28 at a base portion 54. Outer surface 52 of sleeve 30, proximate with base portion 54 has a hexagonal configuration at 56 thereby providing a gripping surface for a wrench or socket tool. A substantially elliptical channel 53 transversely runs within inner surface 50 of sleeve 30. Of course, outer sleeve 30 may be a separately machined part from anvil 28 and threadably joined thereto.

Each die segment 32 has a substantially arcuate cross sectional configuration matching peripheral surface 44 of anvil 28. Each die segment 32 is defined by a shoulder surface 70 and an oppositely disposed bottom surface 72, both of which are joined by an inside surface 74 and an outside surface 76. A substantially elliptical groove 78 circumferentially runs within outside surface 76 of each die segment 32.

Spring 34 is a canted coiled spring made from coated music wire or the like. Spring 34 circumferentially surrounds die segments 32 when installed within die assembly 10. Spring 34 further secures die segments 32 within die assembly 10 by engagement with groove 78 and channel 53. Thus, during the Lance-N-Loc® or the Tog-L-Loc® deformable joining of materials a and b, die segments 32 are transversely or radially moved to positions 32'. In positions 32', die segments 32 expand spring 34 against sleeve 30. This spring expansion is simplified by use of a canted type spring 34. When the material joining is completed and removed from die assembly 10, spring 34 radially urges die segments 32 inward toward anvil 28.

Figure 3:
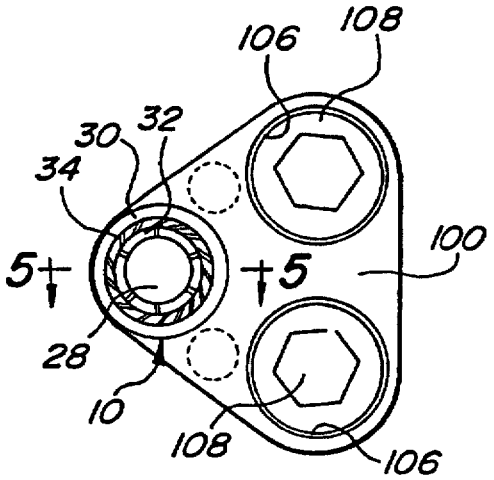
FIG. 3 is a top elevational view showing the first preferred embodiment of a die assembly and die retainer employed in the apparatus of the present invention of FIG. 1.

A die retainer 100 is illustrated in FIGS. 1 through 3. Die retainer 100 has an elongated cylindrical tower 102, a locating pin 104 and a pair of apertures 106 for receiving corresponding fastening bolts 108. Tower 102 has a threaded receptacle 120 for enmeshed engagement of threaded shaft 36 of die assembly 10. Bolts 108 and locating pin 104 serve to retain and secure die retainer 100, and in turn, die assembly 10, to a work surface 122 such as a C-frame clamping device for a standard press or to a table top. Tower 102 and apertures 106 are triangularly oriented in relation to one another as viewed in FIG. 3.

Figure 8:
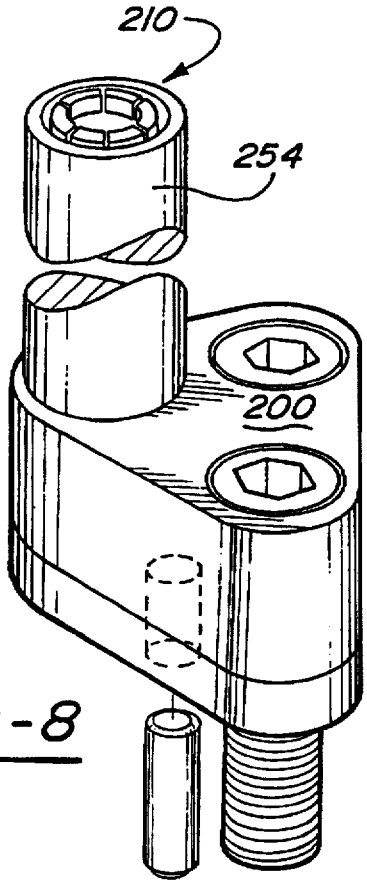
FIG. 8 is a perspective view showing the second preferred embodiment of the die assembly and die retainer of FIG. 7 employed in the apparatus of the present invention.
Figure 7:
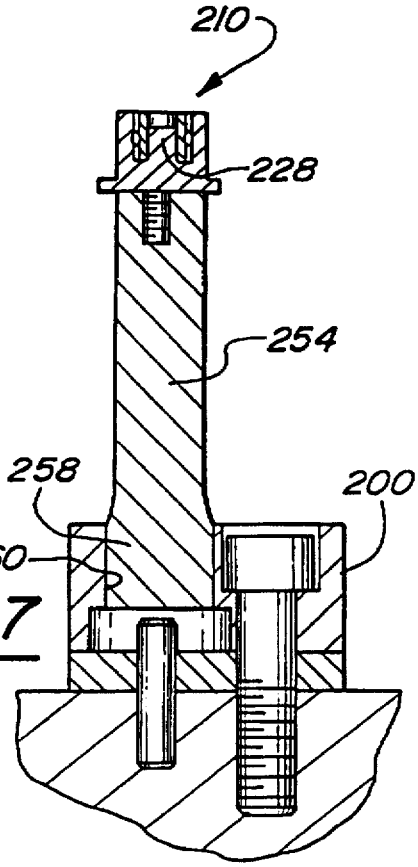
FIG. 7 is a sectional view showing a second preferred embodiment of a die assembly and die retainer employed in the apparatus of the present invention of FIG. 1.

A second preferred embodiment of the apparatus of the present invention is shown in FIGS. 7 and 8. In this embodiment, die assembly 210 is substantially similar to that of the first embodiment, however, a base portion 254 is longitudinally lengthened so as to extend from below anvil 228 to a bulged portion 258. Bulged portion 258 is press fit within an unthreaded receptacle 260 of a die retainer 200. Of course, bulged portion 258 can be threadably enmeshed with receptacle 260 or supplemental bolts may be provided. FIG. 7 shows die assembly 210 as a separate part from a base/tower 254, while FIG. 8 shows them integrated together.

Figure 10:
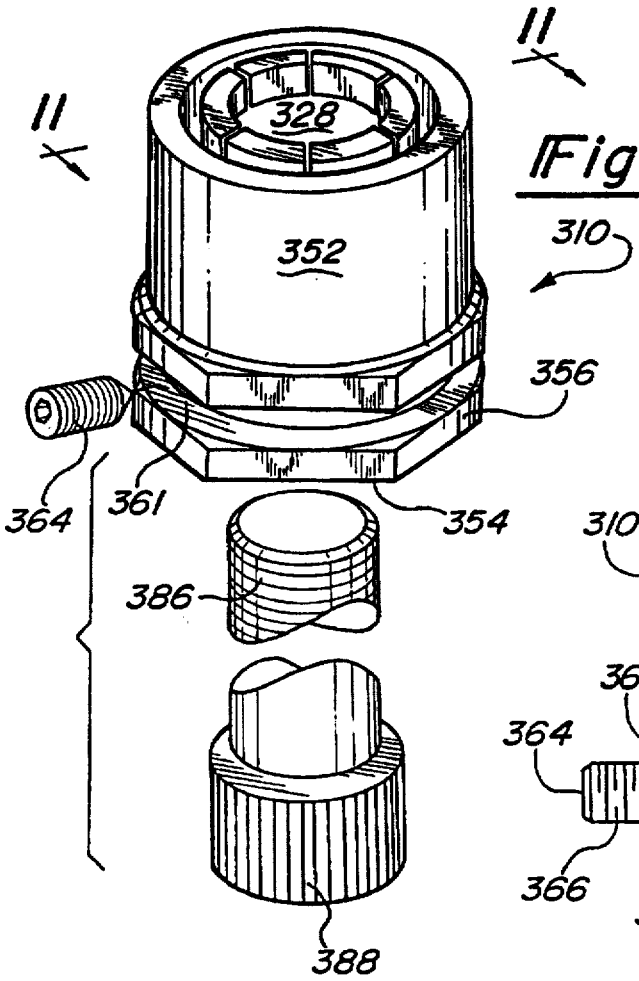
FIG. 10 is a perspective view showing the third preferred embodiment of the die assembly of FIG. 9 employed in the apparatus of the present invention with fasteners exploded away therefrom.
Figure 11:
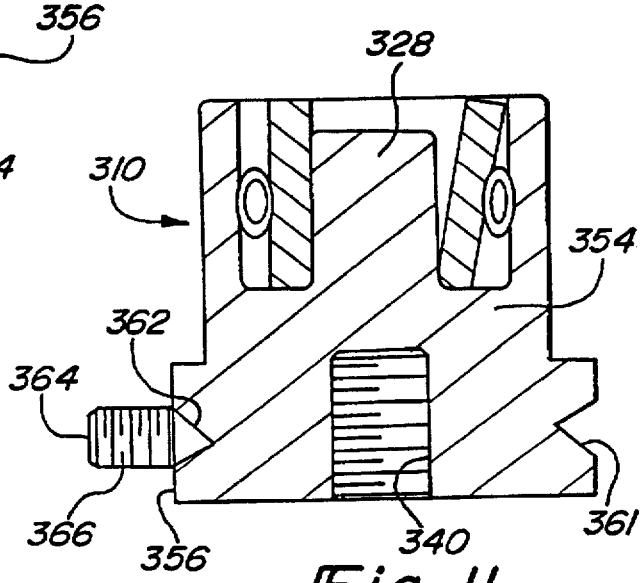
FIG. 11 is an enlarged sectional view, taken along line 11—11 of FIG. 10, showing the third preferred embodiment of the die assembly employed in the apparatus of the present invention.
Figure 9:
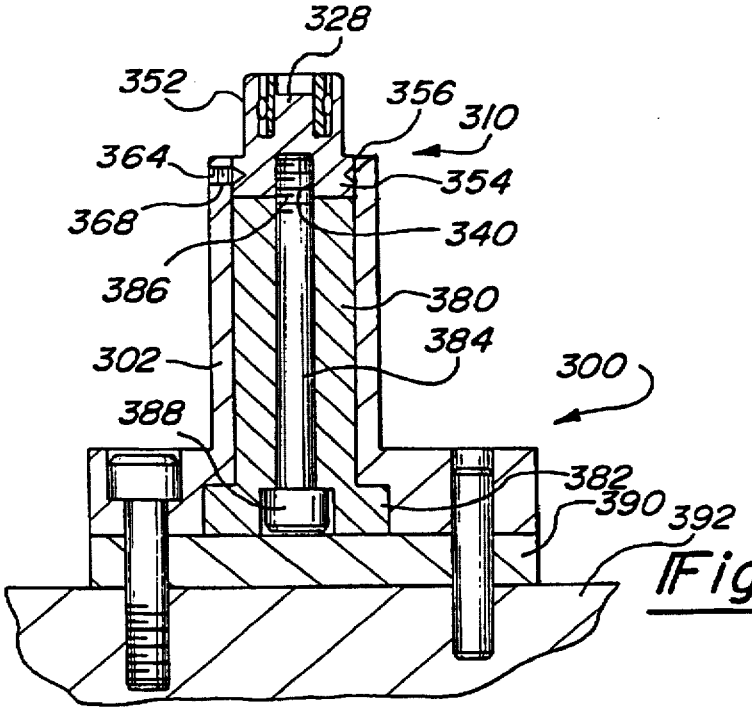
FIG. 9 is a sectional view showing a third preferred embodiment of a die assembly and die retainer employed in the apparatus of the present invention of FIG. 1.

FIGS. 9 through 11 illustrate a third preferred embodiment of the apparatus of the present invention. Die assembly 310 is substantially similar to that of the prior embodiment constructions, however, an internally threaded passage 340 is coaxially aligned with an anvil 328 within a base portion 354. Base portion 354 further has a hexagonal configuration around an outer surface 352 at 356. A V-shaped peripherally running indentation 361 is disposed within hexagonally-shaped surface at 356 for engagement with a conically pointed tip 362 of a set screw 364. Set screw 364 further has a threaded segment 366 which is in enmeshed engagement with a threaded orifice 368 transversely extending through an upper portion of a tower 302 of a die retainer 300. A hollow central insert 380 with a transversely oriented flange 382 is substantially disposed within tower 302 of die retainer 300. A die-securing bolt 384 has a threaded shaft 386 and a head 388. Shaft 386 enmeshably engages with passage 340 of die assembly 310 while head 388 is snugly secured within flange 382 of central insert 380. It should be noted that either set screw 364 or bolt 384 may be used but preferably not both. Thus, die assembly 310 is securely fastened to die retainer 300 and, in turn, to a spacer 390 disposed against a work surface 392.

Figure 12:
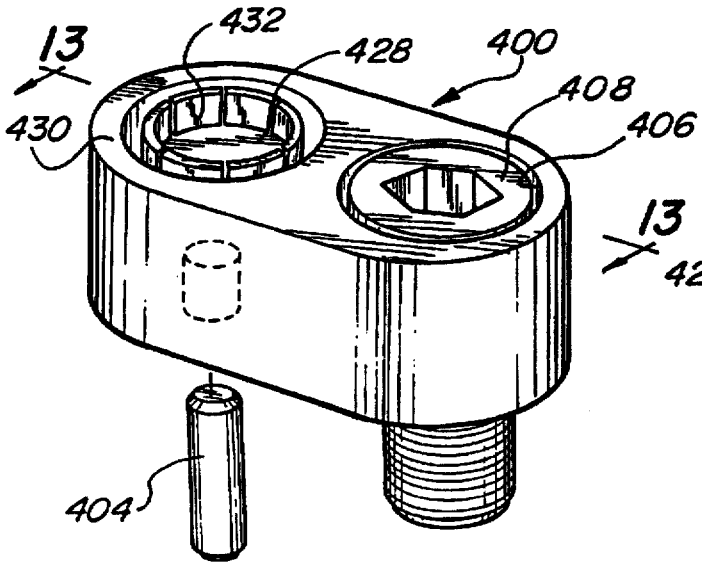
FIG. 12 is a perspective view showing a fourth preferred embodiment of a die assembly and die retainer employed in the apparatus of the present invention of FIG. 1.
Figure 14:
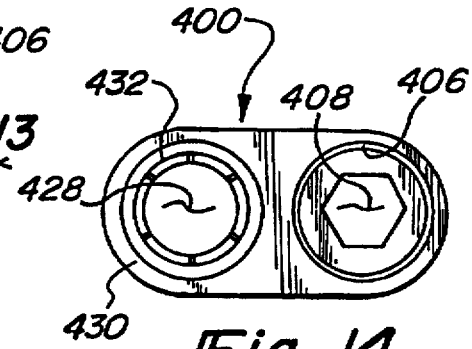
FIG. 14 is a top elevational view showing the fourth preferred embodiment of the die assembly and die retainer of FIG. 12 employed in the apparatus of the present invention.
Figure 13:
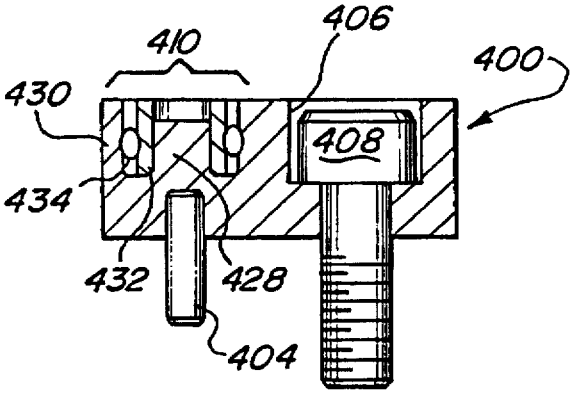
FIG. 13 is a sectional view, taken along line 13—13 of FIG. 12, showing the fourth preferred embodiment of the die assembly and die retainer employed in the apparatus of the present invention.

FIGS. 12 through 14 show a fourth embodiment of the apparatus of the present invention as having a die retainer 400 which is integral with an outer sleeve 430. Outer sleeve 430, an anvil 428, a plurality of die segments 432 and a canted spring 434 define a die assembly 410. Anvil 428, die segments 432 and spring 434 are substantially the same as that of the prior embodiments. A bolt 408 is mounted within a stepped aperture 406 of die retainer 400 for attachment to an adjacent work surface 122 (see FIG. 1). A cylindrical locating pin 404 is also provided.

Figure 17:
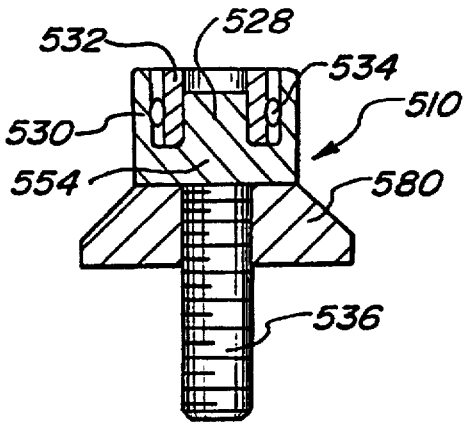
FIG. 17 is a sectional view, taken along line 17—17 of FIG. 16, showing the fifth preferred embodiment of the combined die assembly and die retainer employed in the apparatus of the present invention.
Figure 15:
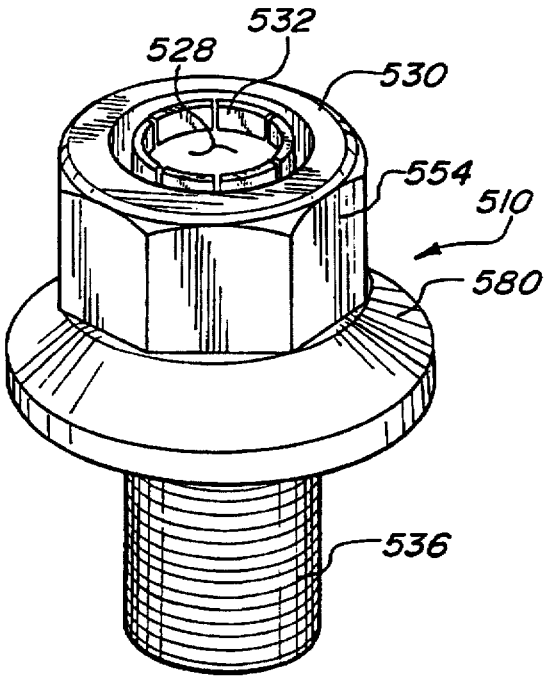
FIG. 15 is a perspective view showing a fifth preferred embodiment of a combined die assembly and die retainer employed in the apparatus of the present invention of FIG. 1.
Figure 16:
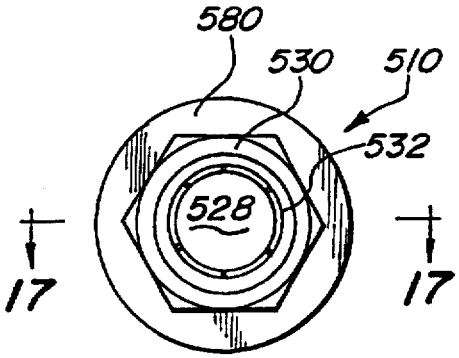
FIG. 16 is a top elevational view showing the fifth preferred embodiment of the combined die assembly and die retainer of FIG. 15 employed in the apparatus of the present invention.

Referring now to FIGS. 15 through 17, a fifth preferred embodiment of the apparatus of the present invention provides a combined die assembly and retainer 510. An anvil 528, sleeve 530, die segments 532 and canted spring 534 are substantially identical to that of the first preferred embodiment. Moreover, a threaded shaft 536 extends from a base portion 554 and through a tapered spacer or skirt 580 for enmeshed engagement to a work surface 122 (see FIG. 1). A separate bolt is not required for fastening.

It will be apparent to one skilled in the art that the present invention offers many advantages over the prior art devices. First, the canted spring provides an easily expandable retainer around the plurality of die segments. Additionally, the canted spring allows for easier effort and greater radial expansion by the die segments. Additionally, the canted spring serves to secure the die segments within the outer sleeve. Notwithstanding, a variety of other non-canted or even non-coiled springs may be employed to retain a plurality of die segments within an outer sleeve, For example, a series of leaf or compression springs may be inserted between each die segment and the adjacent portion of the outer sleeve.

The outer sleeve used in the apparatus of the present invention also provides advantages over prior art devices. The present invention outer sleeve prevents foreign material such as dirt, metal scrap or grease from entering the spring, die segments or anvil. Moreover, the outer sleeve serves to protect the spring and die segments from inadvertent impacts caused by misalignment of material sheets entering between the punch and the die assembly or from other nearby equipment. The outer sleeve also serves as a radial expansion limiter for the spring and the die segments. Further, the outer sleeve has a base portion which can be hexagonally or otherwise shaped for engagement with a wrench or other torque providing tool to aid in assembly and disassembly. The die assembly of the present invention additionally employs a variety of securing means for mounting to a die retainer. Thus, a compact, integrated, easily manufactured, easily disassemblable, low cost die assembly is achieved.

The present invention also provides for the unique set of die retainers which serve to secure a die assembly to a work surface. This is advantageously achieved through the use of a receptacle, fastening means, and an optional locator pin, constructed in a variety of rigid yet easily assembled and disassembled constructions. Various spacers or tapered skirts can also be employed to isolate vibration and to vary functional height of the die assembly.

While the preferred embodiments of this apparatus for joining sheets of material have been disclosed, it will be appreciated that various modifications may be made without departing from the present invention. For example, a die retainer can be constructed in a manner similar to those disclosed which can secure multiple die assemblies to a work surface. Furthermore, while specific press fit and threaded fasteners have been shown between a die assembly and a die retainer, other suitable retention means may be employed. Moreover, a locator rib or formation may be substituted for the inserted locator pin within the disclosed die retainer. Other material joining punches and anvils can be used with the present invention apparatus. While various materials have been disclosed in an exemplary fashion, a variety of other materials may of course be employed. It is intended by the following claims to cover these and any other departures from the disclosed embodiments which fall within the true spirit of this invention.

The invention claimed is:

1. An apparatus for joining sheets of material, said apparatus comprising:

an anvil having a working surface and a peripheral surface;

an outer sleeve substantially surrounding said peripheral surface of said anvil;

an upper portion of a plurality of die segments each having a shoulder surface, said plurality of die segments being movably disposed between said anvil and said outer sleeve; and an upper edge of said outer sleeve projecting at least as high as a plane defined by said shoulder surfaces of said plurality of die segments.

2. The apparatus of claim 1 further comprising a spring engagably securing said plurality of die segments within said outer sleeve.

3. The apparatus of claim 2 further comprising:

a groove transversely disposed along outside surfaces of said plurality of die segments; and a single channel transversely disposed in an inner surface of said outer sleeve;

said spring interfacing in said groove of said plurality of die segments and in said channel of said outer sleeve.

4. The apparatus of claim 3 wherein:

said groove has a substantially elliptical cross section; and said channel has a substantially elliptical cross section.

5. The apparatus of claim 1 further comprising an outer surface of a die assembly, including said outer sleeve and a base portion, having a hexagonal configuration.

6. The apparatus of claim 1 wherein:

said peripheral surface of said anvil is cylindrically shaped; and inside surfaces of said plurality of die segments each have an arcuate configuration.

7. The apparatus of claim 1 wherein said shoulder surfaces of said plurality of die segments longitudinally project beyond said working surface of said anvil.

8. The apparatus of claim 1 further comprising a punch assembly having a punch with a working surface movably opposing said working surface of said anvil, said punch acting to deform said sheets of material against said working surface of said anvil and substantially between said plurality of die segments, said punch, anvil and plurality of die segments serving to create a joint between said sheets of material.

9. The apparatus of claim 1 wherein said anvil and said outer sleeve are fixed and prevented from longitudinal movement.

10. A die assembly for use within a sheet material joining apparatus, said die assembly comprising:

an anvil;

at least one die segment having an outside surface, said die segment being operably movable away from said anvil;

an outer sleeve transversely located outside of said die segment such that said die segment is at least partially disposed between said outer sleeve and said anvil; and a metallic mechanical interlock member retaining and contacting against a generally middle portion of said die segment, said interlock member being disposed between said outer sleeve and said die segment.

11. The die assembly of claim 10 wherein said mechanical interlock member is a means for biasing said die segment toward said anvil.

12. The die assembly of claim 11 further comprising a single and cross sectionally curved first channel disposed in an inner surface of said outer sleeve, said means for biasing being at least partially disposed in said first channel.

13. The die assembly of claim 12 further comprising a single and cross sectionally curved second channel disposed in an outer surface of said die segment, said means for biasing being partially disposed in said second channel.

14. The die assembly of claim 10 wherein said mechanical interlock member is a metallic spring.

15. The die assembly of claim 14 wherein said spring is a coiled spring.

16. The die assembly of claim 15 wherein said coiled spring is a single canted and coiled spring surrounding at least three of said die segments.

17. A die assembly employed within a sheet material joining apparatus, said die assembly comprising:

an anvil having a working surface and a peripheral surface;

an outer sleeve surrounding said peripheral surface of said anvil; and a base integrally joining said anvil to said outer sleeve as a single piece, said outer sleeve being spaced from said anvil, an upper edge of said outer sleeve longitudinally extending beyond said working surface of said anvil.

18. The die assembly of claim 17 wherein said upper edge of said outer sleeve projects higher than said working surface of said anvil which is flat.

19. The die assembly of claim 17 wherein said peripheral surface of said anvil has a substantially cylindrical configuration.

20. The die assembly of claim 17 further comprising an inner surface of said outer sleeve having a single groove.

21. The die assembly of claim 17 wherein said anvil and said outer sleeve are fixed and prevented from longitudinal movement.

22. The die assembly of claim 17 further comprising a threaded shaft longitudinally projecting from said base and being substantially coaxially aligned with said anvil.

23. The die assembly of claim 17 wherein an outer surface of at least one member consisting of the group of: said outer sleeve and said base, has a hexagonal configuration.

24. The die assembly of claim 17 further comprising:

a plurality of die segments disposed between said anvil and said outer sleeve, at least a portion of each of said plurality of die segments being transversely movable away from said anvil; and metallic spring means for biasing said plurality of die segments toward said anvil.

25. A die assembly for use in joining sheets of material, said die assembly comprising:

an anvil having a working surface;

an outer sleeve substantially surrounding said anvil;

a base retaining said outer sleeve to said anvil;

said anvil, said outer sleeve and said base defining a die assembly having an outer surface with a hexagonal configuration; and an upper edge of said outer sleeve projecting higher than said working surface of said anvil.

26. The die assembly of claim 25 further comprising:

a plurality of die segments disposed between said anvil and said outer sleeve, at least a portion of each of said plurality of die segments being transversely movable away from said anvil; and metallic spring means for biasing said plurality of die segments toward said anvil.

27. The die assembly of claim 25 further comprising a peripheral surface of said anvil having a substantially cylindrical configuration.

28. An apparatus comprising:

a die assembly for use in forming a joint between sheets of material, said die assembly including an anvil and a die segment; and a die retainer for retaining said die assembly to a clamp, said die retainer including an elongated tower having a diameter of a cylindrical external surface laterally greater than a diameter of said die segment, said die assembly being mounted to a top of said tower, said die retainer further including a transversely enlarged base having a through aperture for receiving a fastener.

29. The apparatus of claim 28 wherein said base has a transverse substantially triangular shape.

30. The apparatus of claim 29 wherein said base further has a second through aperture for receiving a second fastener.

31. The apparatus of claim 30 further comprising a locating pin longitudinally projecting from a bottom of said base.

32. The apparatus of claim 30 wherein said through apertures and said tower are triangularly disposed in transverse relationship to each other.

33. The apparatus of claim 28 wherein said tower is created separately from said base.

34. The apparatus of claim 33 further comprising a bottom of said tower being pressfit into a receptacle of said base.

35. The apparatus of claim 33 further comprising a bottom of said tower being threadably enmeshed in a threaded receptacle of said base.

36. The apparatus of claim 28 herein said tower a threaded receptacle enmeshing with a threaded shaft projecting from said die assembly.

37. The apparatus of claim 28 wherein said tower is at least twice as tall as said die assembly.

38. The apparatus of claim 28 wherein said die retainer further includes:

a hollow central insert having an outwardly extending flange, said central insert being surrounded by said tower; and a bolt upwardly extending through said central insert, a threaded end of said bolt engaging said die assembly and a head of said bolt abutting against a portion of said central insert.

39. The apparatus of claim 28 further comprising a set screw having a threaded portion engaging said tower and having a point engaging said die assembly.

40. An apparatus for joining sheets of material, said apparatus comprising:

a die retainer having a through aperture for receiving a bolt mounted to a work surface, said die retainer further having an open cavity;

an anvil disposed in said cavity; and a sleeve portion of said die retainer surrounding a peripheral surface of said anvil, an upper edge of said sleeve portion longitudinally extending beyond said anvil.

41. The apparatus of claim 40 wherein said anvil is integrally created with said die retainer as a single piece.

42. The apparatus of claim 41 wherein said sleeve portion of said die retainer is integrally created with said die retainer and said anvil as a single piece.

43. The apparatus of claim 40 wherein said through aperture is transversely offset from said anvil.

44. The apparatus of claim 43 further comprising a locating pin depending from said die retainer and being substantially coaxially aligned with said anvil.

45. The apparatus of claim 40 wherein said peripheral surface of said anvil has a substantially cylindrical shape.

46. The apparatus of claim 40 further comprising an upper shoulder of said sleeve portion being taller than a working surface of said anvil.

47. The apparatus of claim 40 further comprising:

a plurality of movable die segments located between said anvil and said sleeve portion of said die retainer; and metallic spring means disposed between said plurality of die segments and said sleeve portion for biasing said plurality of die segments toward said anvil.

48. The apparatus of claim 40 further comprising a head of said bolt, said through aperture having a step for receiving said head of said bolt.

49. The apparatus of claim 40 wherein said die retainer has a generally elongated ovular transverse shape.

50. An apparatus for joining sheets of material comprising:

a die assembly having an anvil and a set of movable die segments biased toward said anvil;

a fastener extending from a bottom of said die assembly and being substantially coaxially aligned with said anvil; and a spacer surrounding a portion of said fastener and being located against a bottom of said die assembly, said spacer having a tapered external surface.

51. The apparatus of claim 50 further comprising:

an outer sleeve surrounding a substantially cylindrical peripheral surface of said anvil; and metallic spring means being disposed between said set of die segments and said outer sleeve for biasing said set of die segments toward said anvil.

52. The apparatus of claim 51 further comprising an outer surface of said outer sleeve having a hexagonal configuration.

53. The apparatus of claim 50 wherein said spacer has a frusto conical taper angling inward toward said die assembly, and said spacer also has a cylindrical external surface disposed furthest away from said die assembly.

54. The apparatus of claim 50 wherein said fastener is a threaded shaft.

55. The apparatus of claim 50 wherein said anvil is fixed and prevented from longitudinal movement after installation.

* * * * *

UNITED STATES PATENT AND TRADEMARK OFFICE

CERTIFICATE OF CORRECTION

PATENT NO. : 5,709,019
DATED : January 20, 1998
INVENTOR(S) : Edwin G. Sawdon

It is certified that error appears in the above-indentified patent and that said Letters Patent is hereby corrected as shown below:

On the Title Page, under Notice, "Jan. 13, 2014" should be -- Jan. 31, 2014 --.

On the Title Page under Related U.S. Application Data, "5,479,187" should be -- 5,479,687 --.

On the Title Page under Foreign Patent Documents, reference 1,041,119, "9/1986" should be -- 9/1966--.

Column 4, line 2, "®" (first occurrence) should be -- ™ --.

Column 8, line 29, "herein" should be -- wherein --.

Column 8, line 29, after "tower" insert -- includes --.

Signed and Sealed this

Twenty-seventh Day of October, 1998

*Attest:*

*Attesting Officer*

BRUCE LEHMAN

*Commissioner of Patents and Trademarks*